US005571230A

United States Patent [19]

Berg

[11] Patent Number: 5,571,230

[45] Date of Patent: Nov. 5, 1996

[54] HAND-TOOL-ASSEMBLABLE AND -DISASSEMBLABLE BUILDING

[76] Inventor: Gaylon Berg, P.O. Box 70227, Eugene, Oreg. 97401

[21] Appl. No.: 64,758

[22] Filed: May 19, 1993

[51] Int. Cl.[6] ..... E04B 2/76

[52] U.S. Cl. ..... 52/585.1; 52/271; 52/587.1

[58] Field of Search ..... 52/272, 270, 271, 52/584.1, 585.1, 587.1, 292, 274

[56] References Cited

U.S. PATENT DOCUMENTS

| | | | |
|---|---|---|---|
| 2,347,049 | 4/1944 | Green | 52/584.1 |
| 2,691,242 | 10/1954 | Young | 52/270 |
| 3,187,852 | 10/1962 | Carman et al. | 189/2 |
| 3,277,621 | 4/1964 | Merdich | 52/86 |
| 3,665,662 | 5/1972 | Timbrook | 52/262 |
| 3,671,063 | 6/1972 | Slayden | 52/584.1 |
| 3,685,241 | 8/1972 | Cooper | 52/274 X |
| 3,706,168 | 12/1972 | Pilish | 52/262 X |
| 3,766,696 | 10/1973 | Totoonchie | 52/584.1 X |
| 3,961,442 | 6/1976 | Carter | 47/17 |
| 3,975,878 | 8/1976 | Modarelli, Jr. | 52/285 |
| 3,984,948 | 10/1976 | Bussard | 52/69 |
| 4,012,871 | 3/1977 | Netto et al. | 52/79.4 |
| 4,045,937 | 9/1977 | Stucky | 52/745 |
| 4,051,641 | 10/1977 | Elliott | 52/262 |
| 4,167,838 | 9/1979 | Metheny | 52/79.5 |
| 4,171,596 | 10/1979 | Varlonga | 52/79.5 |
| 4,633,626 | 1/1987 | Freeman et al. | 52/71 |
| 4,837,991 | 6/1989 | Shaw | 52/274 X |
| 4,852,309 | 8/1989 | Stamp, Sr. | 52/79.6 |
| 4,993,205 | 2/1991 | Dull | 52/584.1 |
| 5,058,347 | 10/1991 | Schuelke | 52/584.1 X |

*Primary Examiner*—Carl D. Friedman
*Assistant Examiner*—Beth A. Aubrey
*Attorney, Agent, or Firm*—Stratton Ballew PLLC

[57] ABSTRACT

A building comprising prefabricated exterior walls, prefabricated interior walls, prefabricated roofpanels and roof panel supports, and designed for assembly and disassembly using only hand tools. The panels are anchored to a concrete slab or foundation.

1 Claim, 26 Drawing Sheets

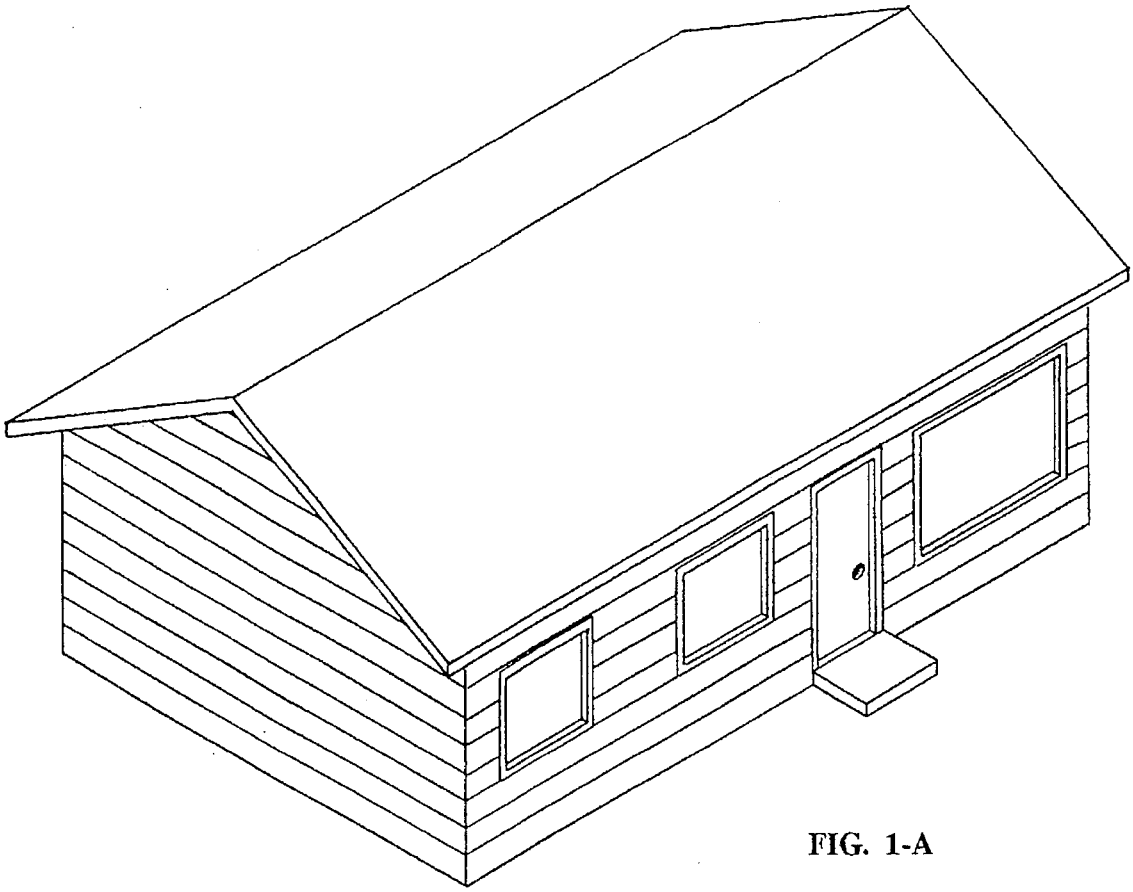
FIG. 1-A

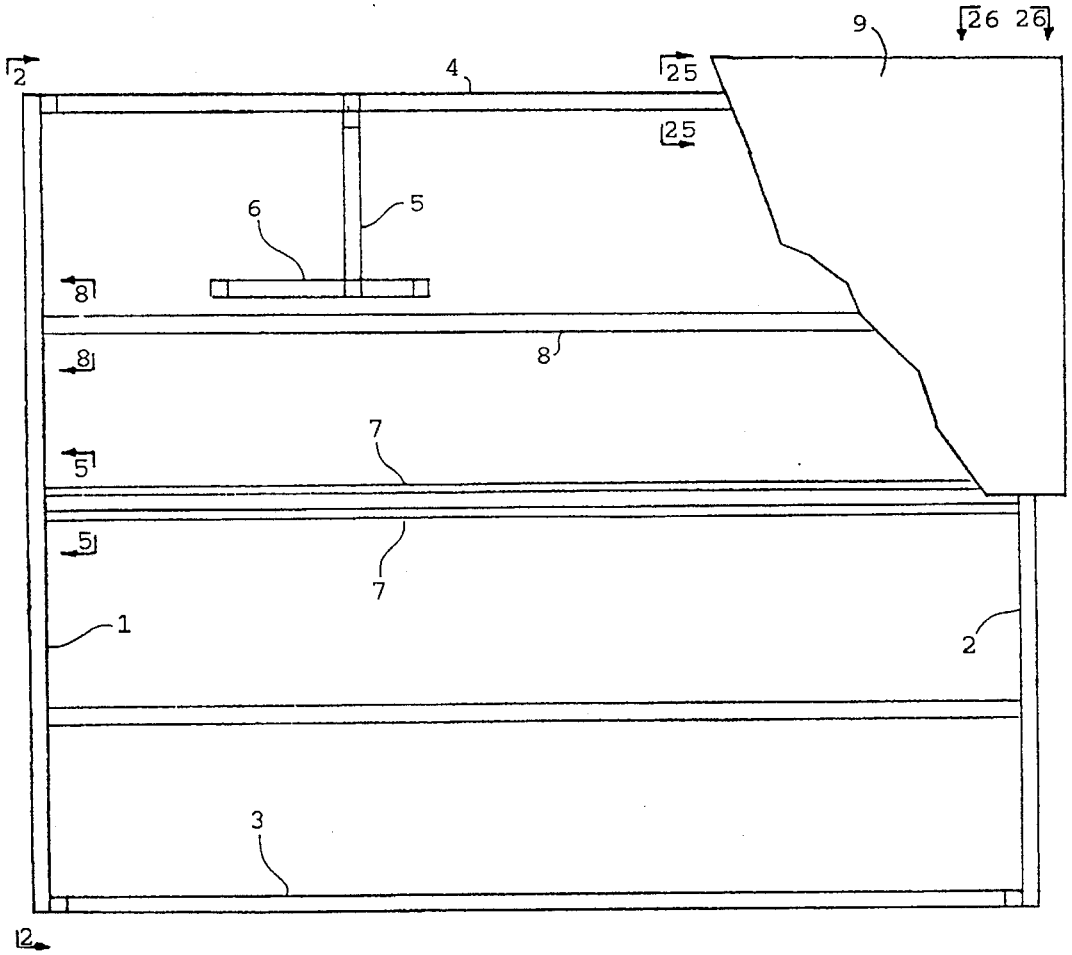
FIG. 1-B

HAND-TOOL-ASSEMBLABLE AND -DISASSEMBLABLE BUILDING

BACKGROUND OF THE INVENTION

This invention relates to a building which can be assembled and disassembled using only hand tools. The building can be suitable for commercial use, for multi-family dwellings, for nursing homes, veterinary or light medical, and single-family residential use. With many of these types of structures, it may happen that the location of a new structure is proper at the time of erection but, as time passes, a different location or an addition to the existing building would be desirable. While the building may be perfectly suitable for the owner's business, in the usual situation, the building must be vacated and a new building erected. This invention voids the necessity for such abandonment and new investment.

Utilizing this invention, if it is desired to change the location of the building, it is necessary only to pour a concrete pad at the new location, disassemble the building, and reassemble it at the new and more desirable location. Alternatively, if it is desired to add to the existing structure, it is necessary only to pour a concrete pad at the addition site, disassemble the adjoining wall and assemble the new addition to the existing building.

The structure illustrated herein is a single family residence. The method of construction, however, is suitable for any form of building, whether commercial, medical or residential.

BRIEF SUMMARY OF THE INVENTION

The preferred embodiment comprises two exterior side wall panels, two exterior end wall panels, two gable walls, interior wall panels as required to configure the interior space, roof panels, steel roof purlins at the ridge and, if required, purlins at the midpoint between the ridge and the side wall panels. The building is constructed on a concrete pad. Holes are drilled in the concrete pad for the anchor bolts which secure the exterior and interior walls to the pad. Typical residential or commercial doors and windows will be shop-installed as required by the particular building being erected.

BRIEF DESCRIPTION OF THE DRAWINGS

FIG.1-A is a perspective view of a residential building.

FIG. 1-B is a plan view of the building framing and showing, in part, the location of the ridge and midpoint purlins, and a portion of the roof panels and interior walls.

DETAILED DESCRIPTION OF THE INVENTION

Figure 2:
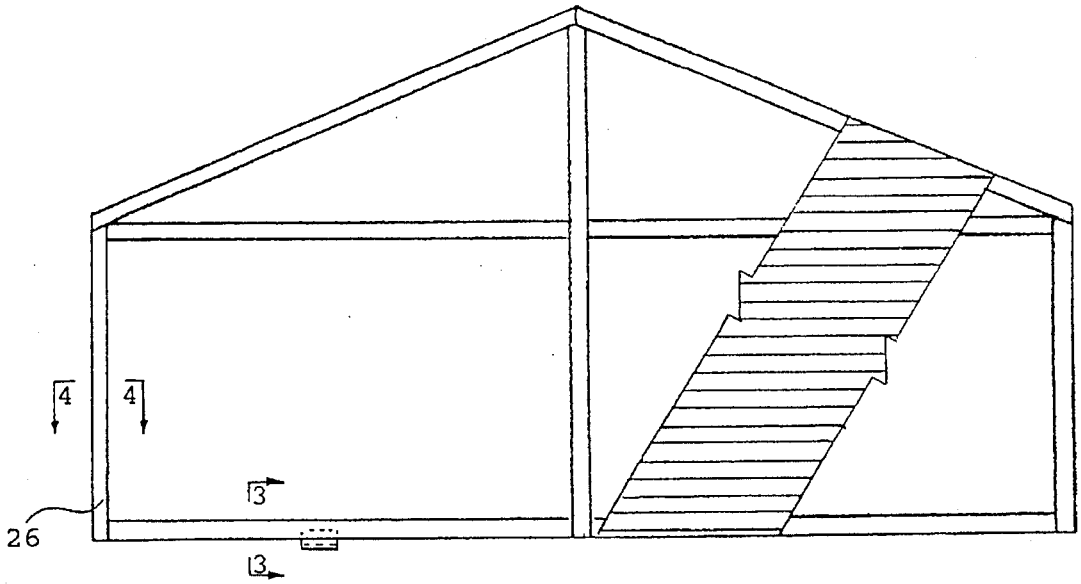
FIG. 2 is an elevation view of an end wall, showing in part some siding attached.

The plan view of FIG. 1-B shows the end wall panels 1 and 2 and the side wall panels 3 and 4, which are joined together by the exterior wall connection detailed in FIGS. 11–19, thus forming a rectangular structure. Interior wall panels 5 and 6 are joined together, and to exterior wall 4 by the interior wall connection detailed in FIGS. 19–24. All exterior and interior walls are anchored to the slab as detailed in FIG. 3. Ridge purlins 7 are joined to end walls 1 and 2 and to intermediate support walls when required as detailed in FIG. 5. Midpoint purlins 8 are joined to end walls 1 and 2 and to intermediate support walls when required as detailed in FIG. 8. Roof panel 9 is attached to side walls 3 and 4 as detailed in FIG. 25, and to end walls 1 and 2 as detailed in FIG. 26.

The interior and exterior wall panel frames are constructed of square or rectangular steel tubing and angle iron. All exterior wall panels and some structurally supportive interior walls are constructed with steel decking welded to the steel panel frame to provide the required shear strength. The exterior walls are then layered with rigid insulation to achieve the desired insulation "R" value. The exterior face of the exterior wall panels may be covered with any one of many available exterior finishes. The interior walls are filled with rigid insulation and the gypsum board is attached to the interior and exterior wall panels with adhesive and drywall screws.

Figure 3:
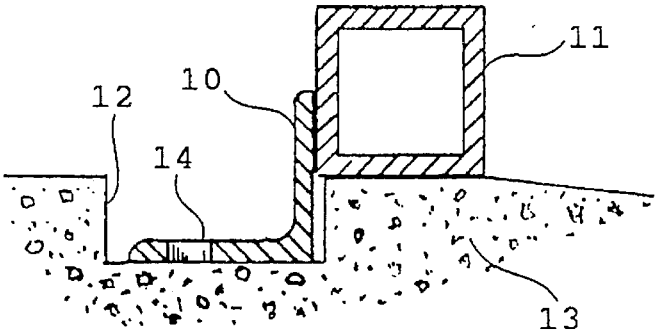
FIG. 3 is a cross-section of an end wall anchoring detail taken at line 3—3 of FIG.2.
Figure 4:
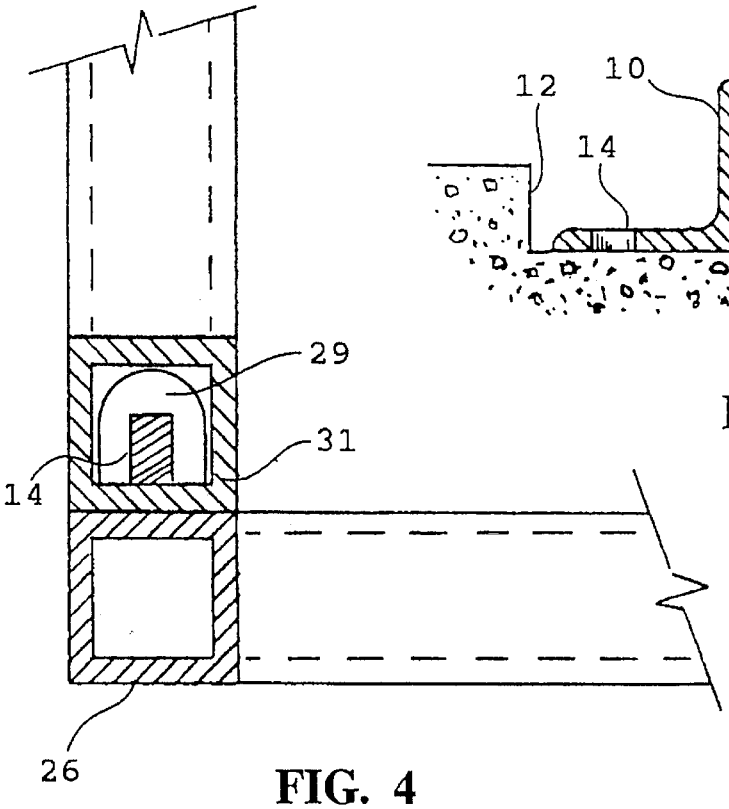
FIG. 4 is a cross-section of the joining construction of an end wall and a side wall taken at line 4—4 of FIG. 2.

The method of anchoring the wall frames to the concrete pad is illustrated in FIG. 3. Angle iron 10 is welded to lowermost horizontal member 11 of end wall frame 1. Angle iron 10 rests on the bottom of groove 12 in concrete pad 13. Opening 14 is provided in angle iron 10 for an anchor bolt (not shown).

Figure 5:
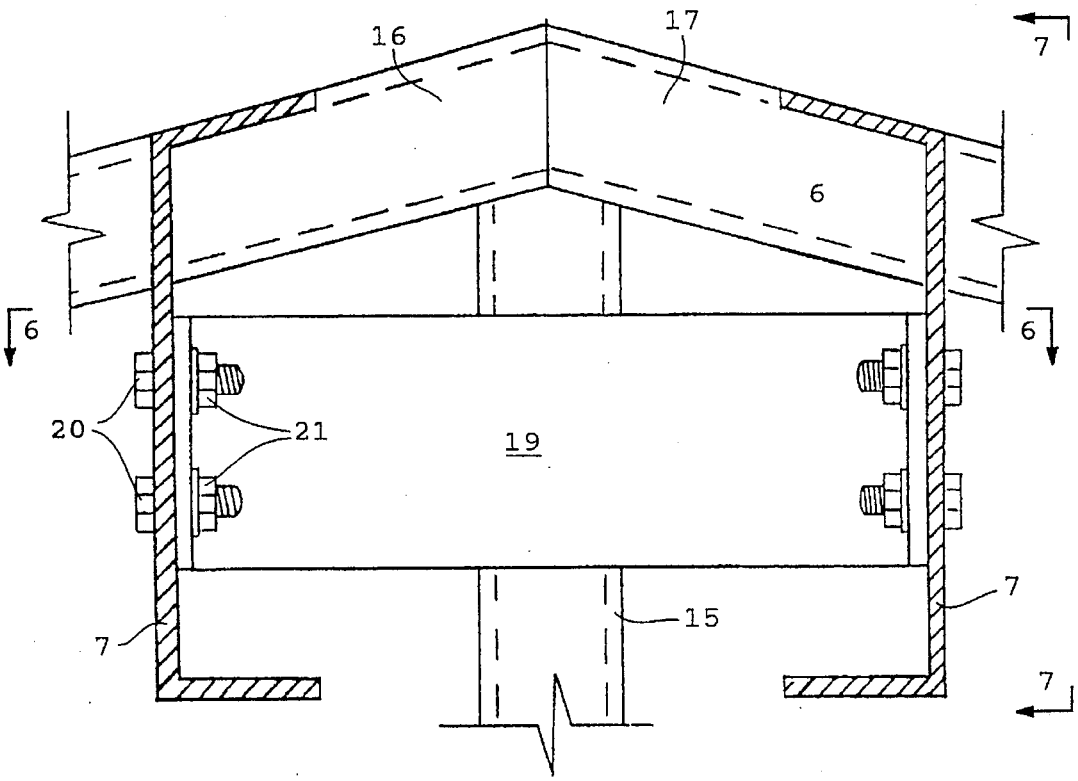
FIG. 5 is an elevation view of the ridge section of an end wall showing purlin supports taken at line 5—5 of FIG. 1-B.
Figure 6:
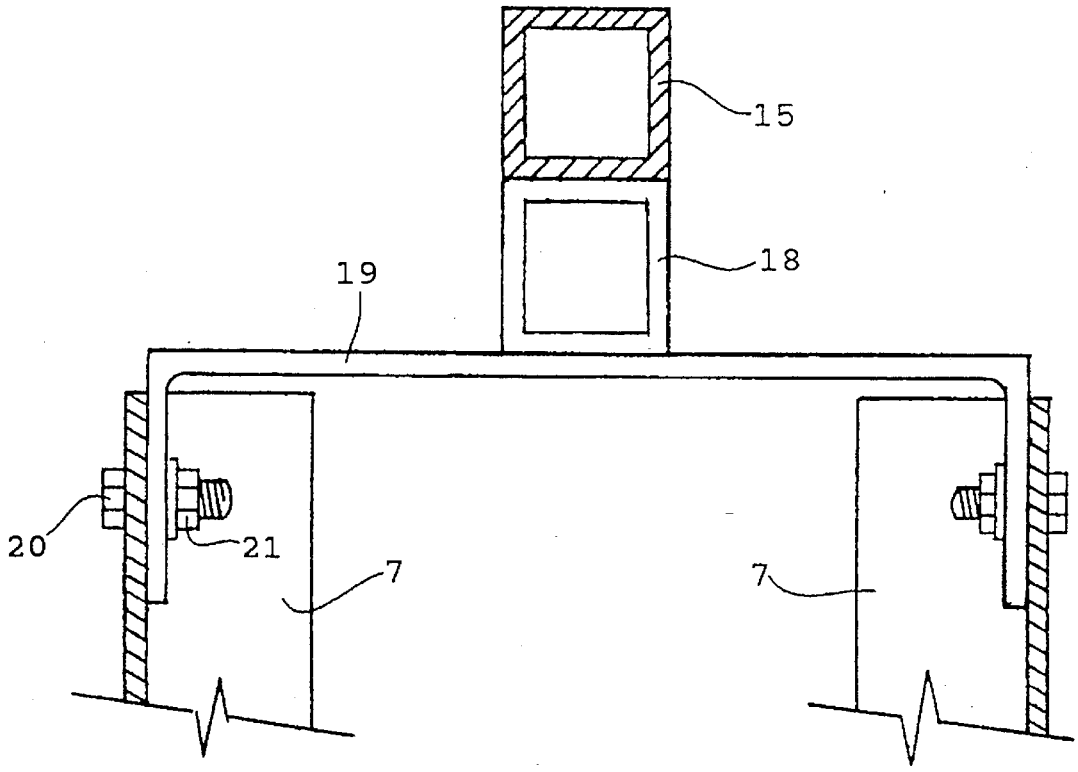
FIG. 6 is a plan view of the structure of FIG. 5 taken at line 6—6 of FIG. 5.
Figure 7:
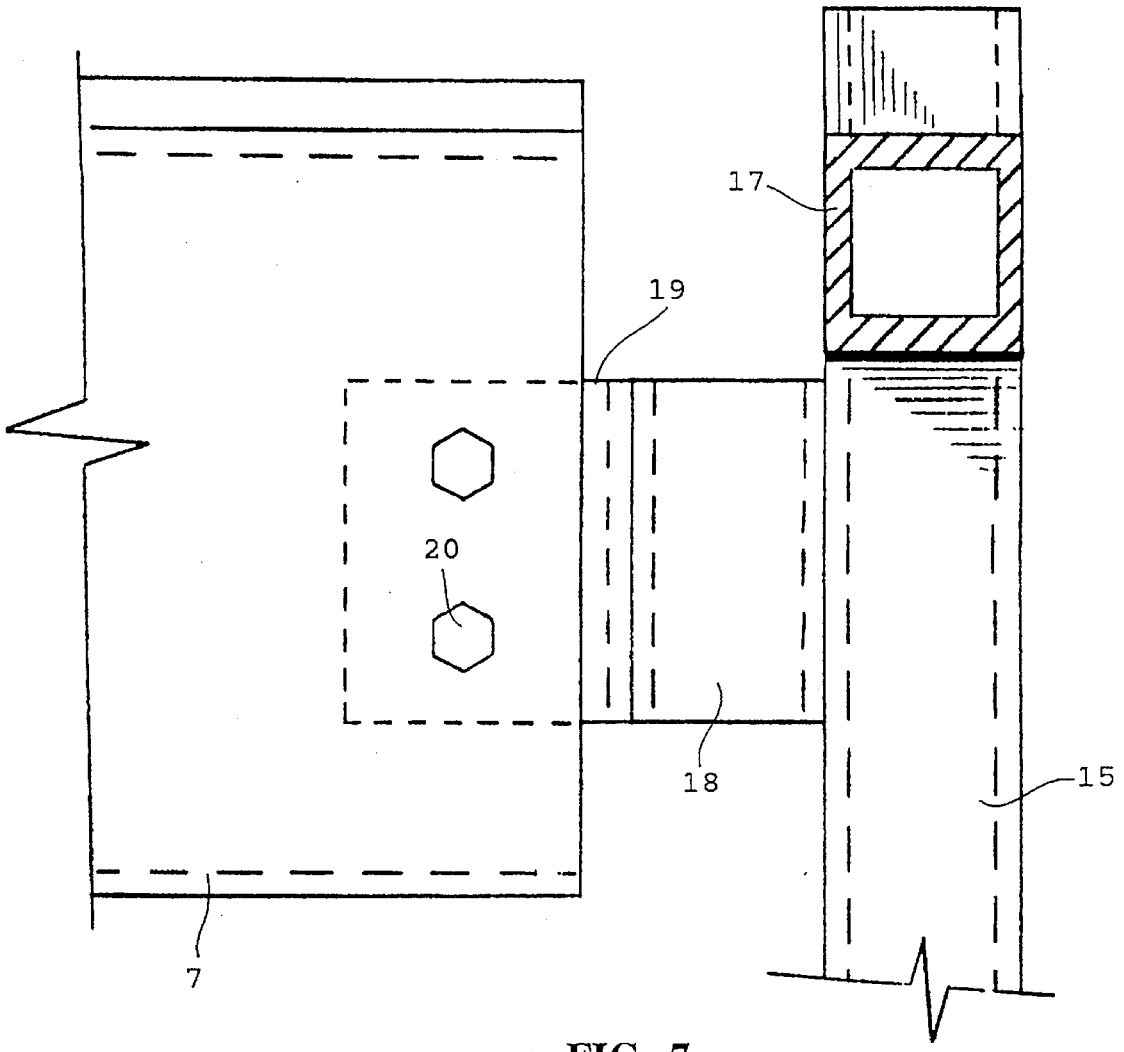
FIG. 7 is a side elevational view of the structure of FIG. 5 taken at line 7–7 of FIG. 5.

Attachment of the ridge purlins 7 to end wall frame 1, for example, is shown in FIGS. 5–7. Vertical member 15 of end wall frame 1 is welded to the two sloping members 16 and 17 of end wall frame 1. Spacer 18 is welded to vertical member 15 and to channel 19. Channel 19 is provided with bolt holes in the channel legs for attachment of purlins 7 by means of bolts 20 and nuts 21.

Figure 8:
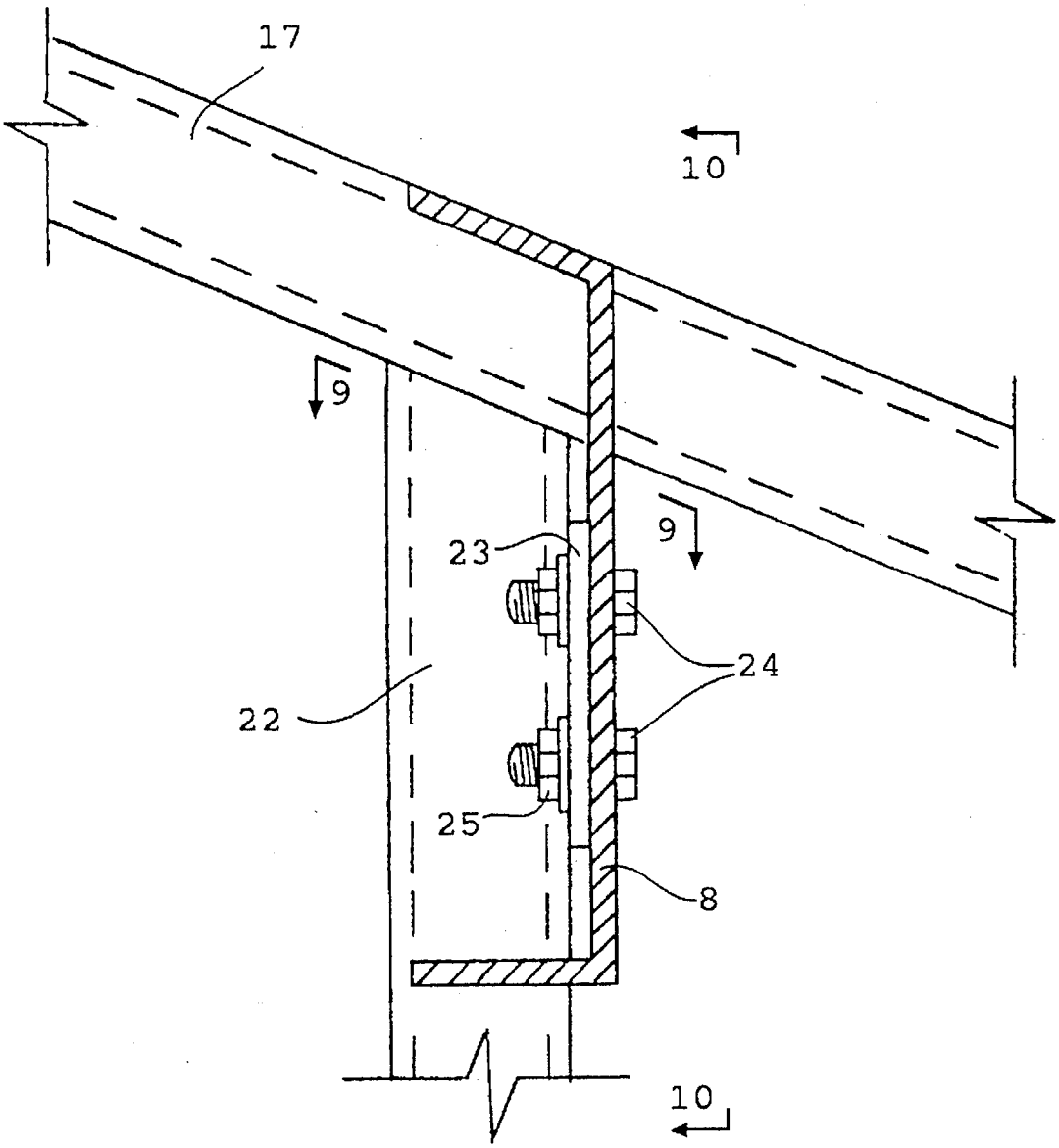
FIG. 8 is an elevational view of an intermediate purlin support taken at line 8—8 of FIG. 1-B.
Figure 9:
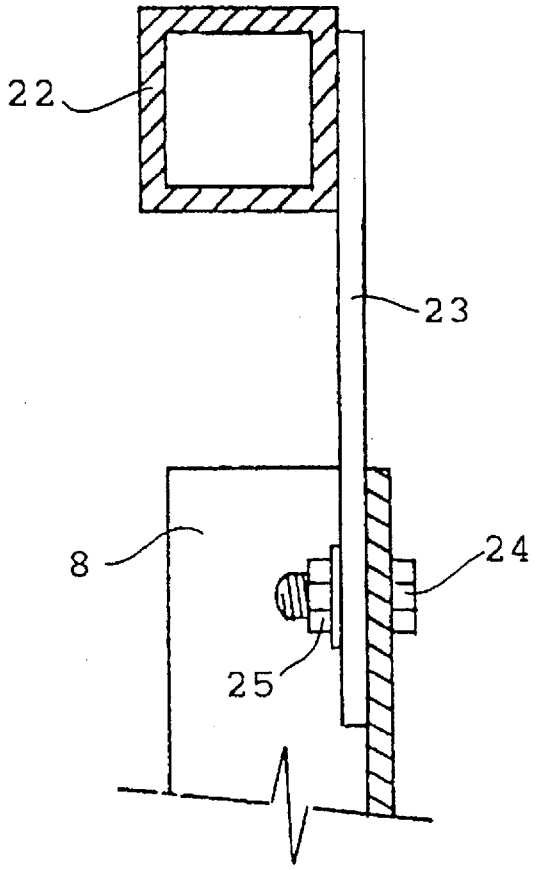
FIG. 9 is a cross-section view of the intermediate purlin support taken at line 9—9 of FIG. 8.
Figure 10:
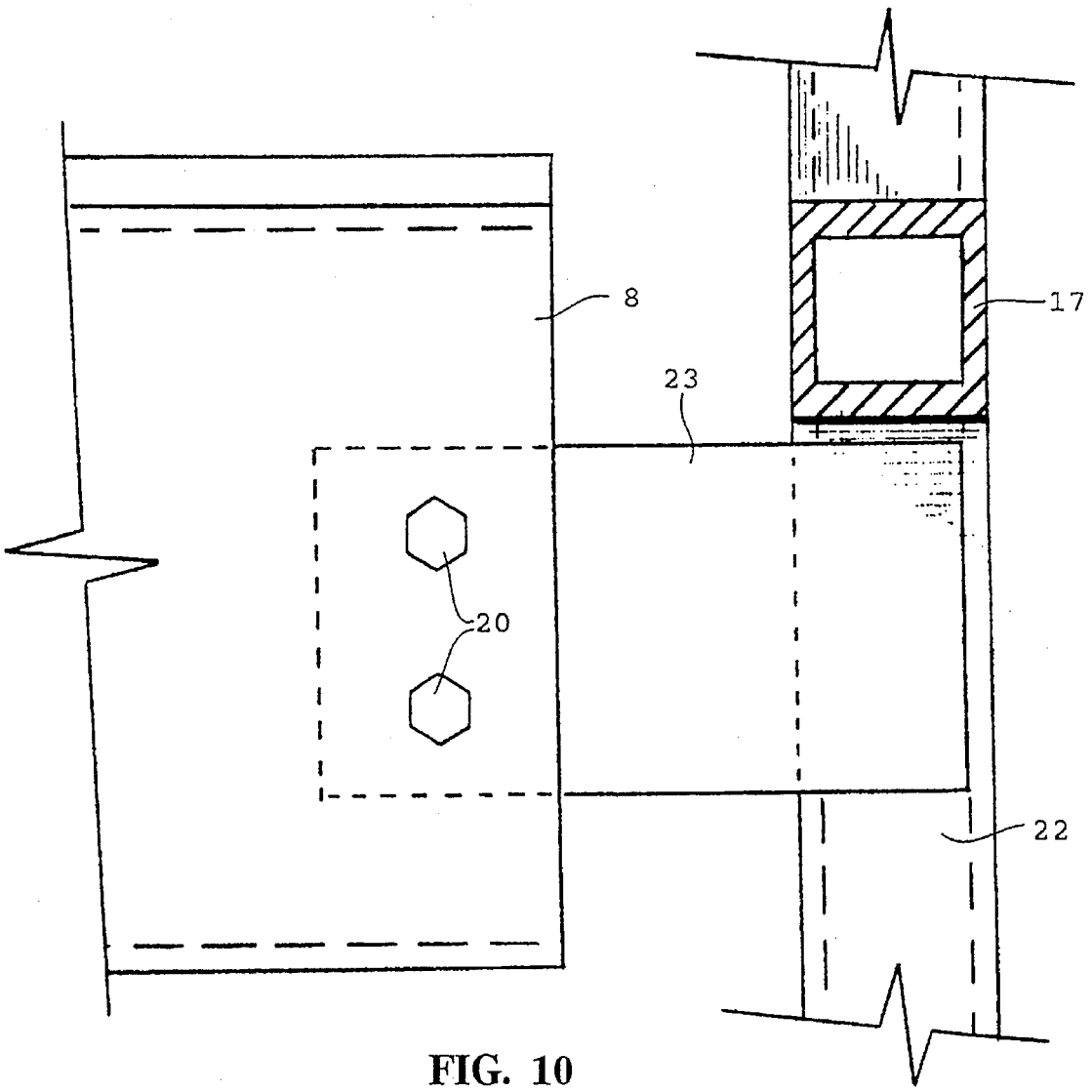
FIG. 10 is a side elevational view of the intermediate purlin support taken at line 10—10 of FIG. 8.

Attachment for intermediate purlins is illustrated in FIGS. 8–10. Sloping member 17 of end wall frame 1 is supported by vertical member 22. Plate 23 is welded to vertical member 22 and extends horizontally inward therefrom. Plate 23 is provided with bolt holes for attachment of intermediate purlin 8 by means of bolts 24 and nuts 25.

Figure 11:
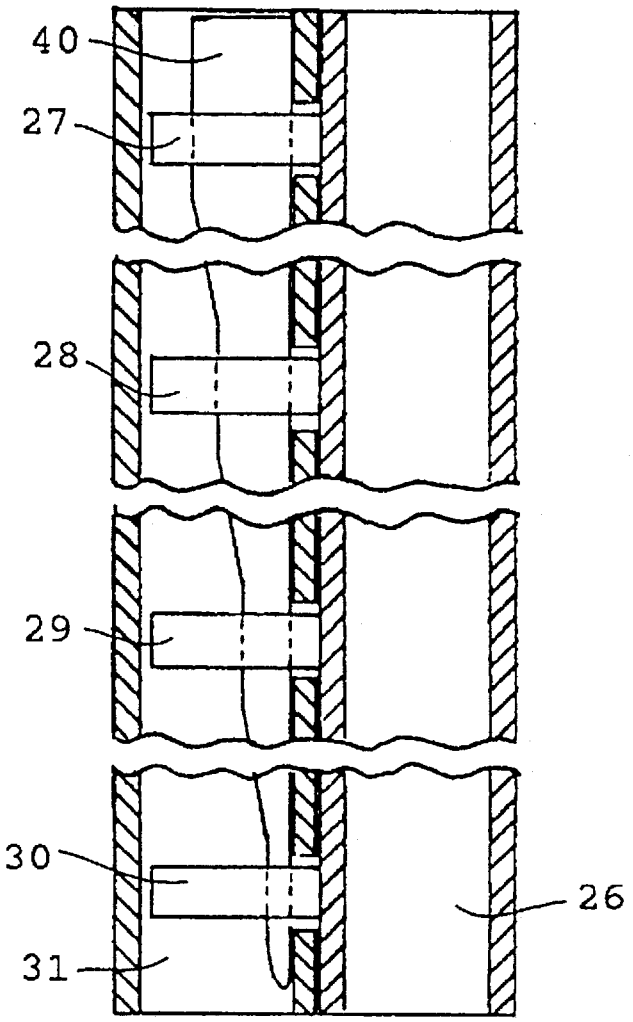
FIG. 11 is a cross-sectional view of the connection of two exterior walls.
Figure 12:
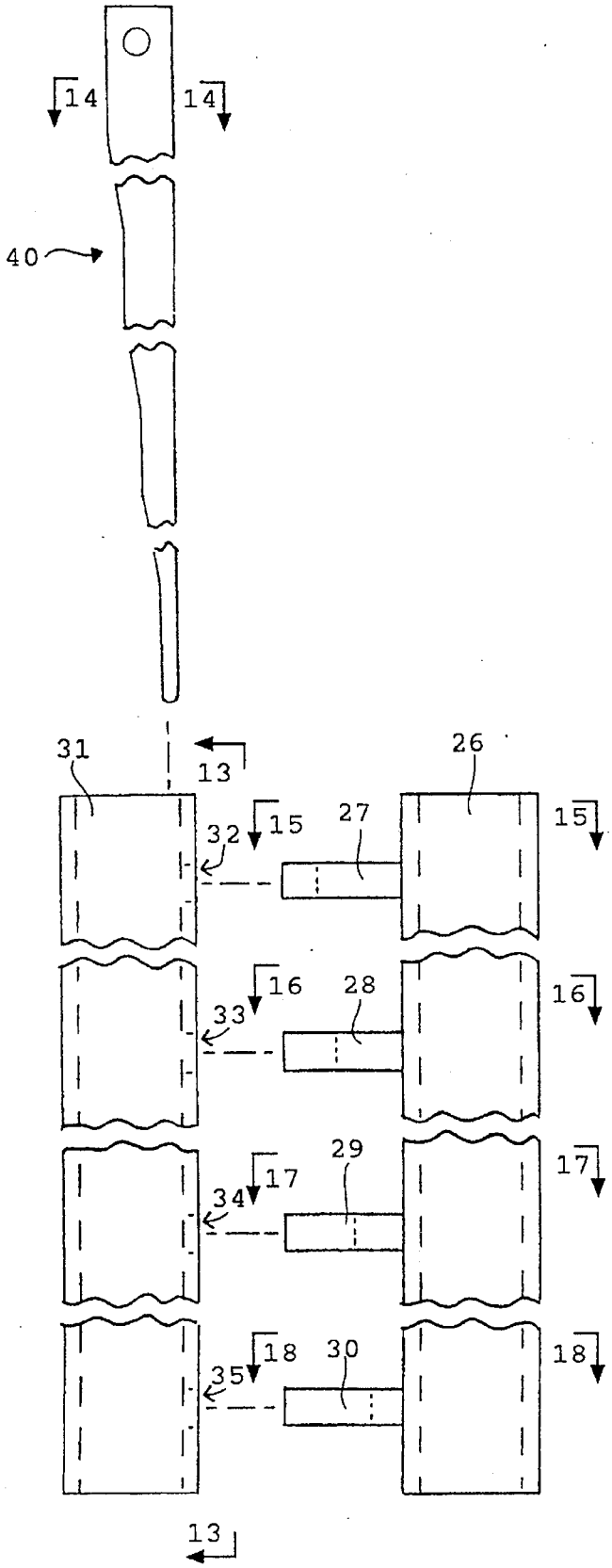
FIG. 12 is an elevational view of the vertical elements of two exterior walls and their connection pin before joining of the walls, and showing openings in phantom.
Figure 13:
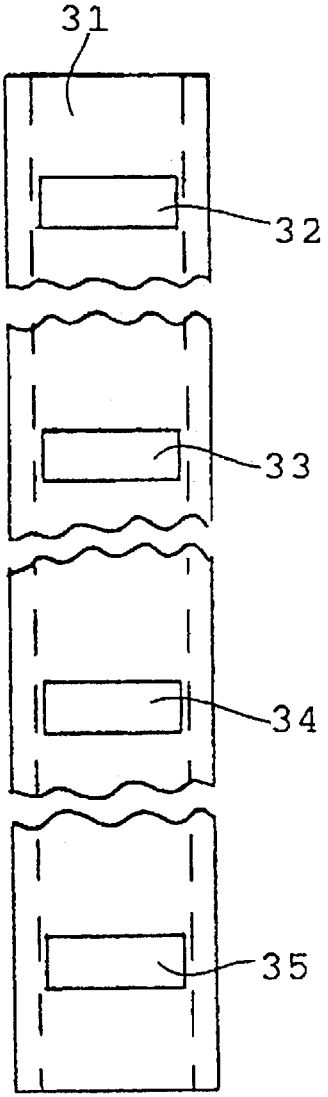
FIG. 13 is an elevational view of the right-hand vertical element of FIG. 12 showing the joining tabs.
Figure 14:
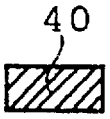
FIG. 14 is a cross-sectional view of the connection pin of FIG. 12.
Figure 15:
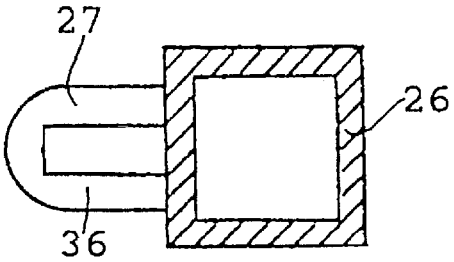
FIG. 15 is a plan view of the uppermost connection tab taken at line 15—15 of FIG. 12.
Figure 16:
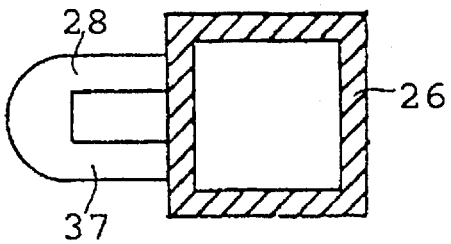
FIG. 16 is a plan view of the next-to-uppermost connection tab taken at line 16—16 of FIG. 12.
Figure 17:
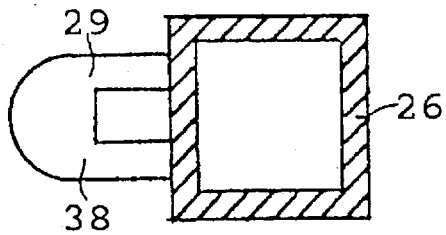
FIG. 17 is a plan view of the next-to-lowermost connection tab taken at line 17—17 of FIG. 12.
Figure 18:
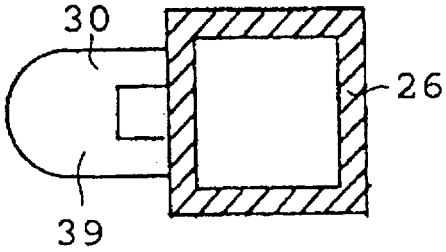
FIG. 18 is a plan view of the lowermost connection tab taken at line 18—18 of FIG. 12.

Corner attachment of an end wall to a side wall is illustrated in FIG. 4 and FIGS. 11–18. End vertical member 26 of side wall 4 is provided with tabs 27, 28, 29 and 30 which extend horizontally from vertical member 26, and are evenly spaced apart. End vertical member 31 of end wall 1 is provided with four rectangular openings 32, 33, 34 and 35 at the same level as tabs 27, 28, 29 and 30 to receive said tabs. It will be noted that the tabs 27, 28, 29 and 30 each has a rectangular opening denominated 36, 37, 38 and 39 respectively beginning at the base of the tab. The openings 36, 37, 38 and 39 are progressively smaller. The connection pin 40 which joins the wall sections is illustrated at the left side of FIG. 13. Connection pin 40 has five rectangular cross-sections, each of the lower 4 being suitable for a sliding fit within one of the openings 36, 37, 38 and 39. The assembled vertical members 26 and 31 are illustrated in FIG. 11 which shows connection pin 40 in place. All exterior wall sections are joined together in the above manner.

Figure 20:
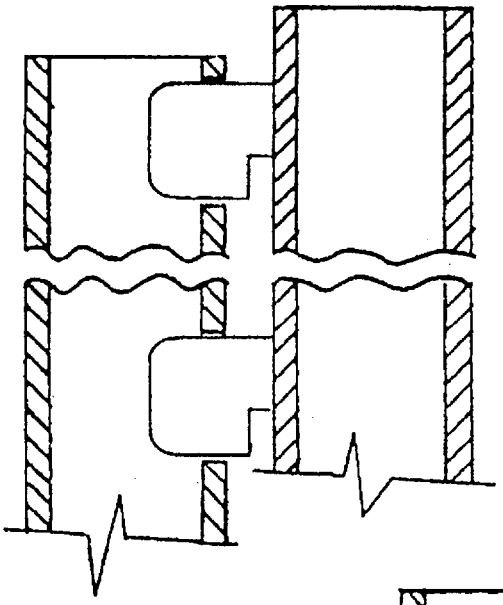
FIG. 20 is a partial cross-section view of an interior wall connection showing the walls partially assmbled.
Figure 19:
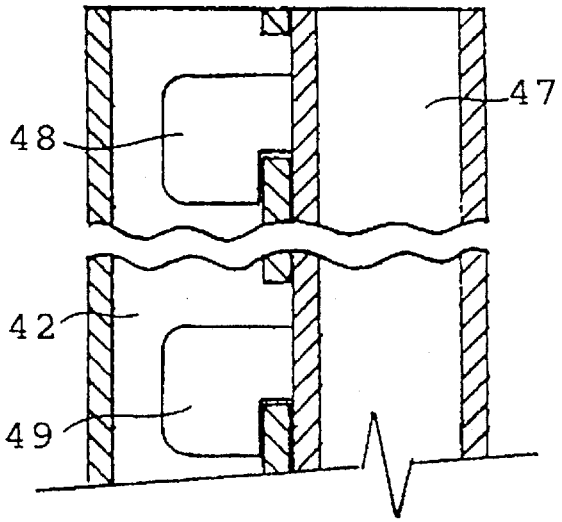
FIG. 19 is a partial cross-section view of an interior wall connection showing the connection assembled.
Figure 21:
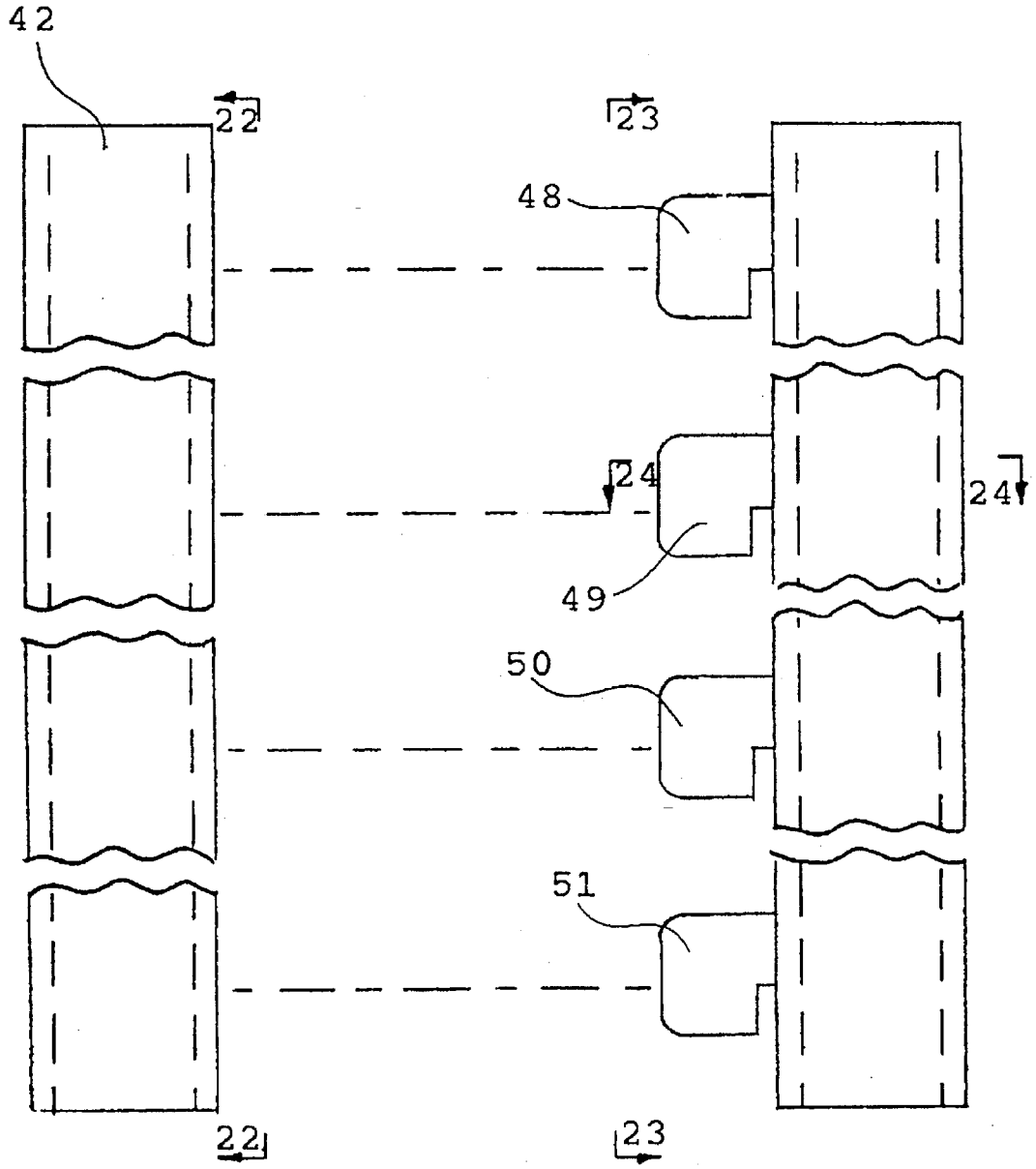
FIG. 21 is an elevational view of an the vertical elements of two interior wall sections before assembly.
Figure 22:
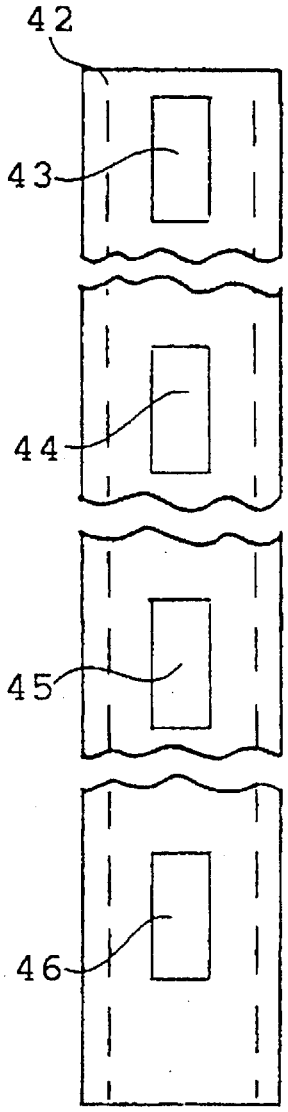
FIG. 22 is an elevational view of the left-hand vertical wall element of FIG. 21 showing the openings.
Figure 23:
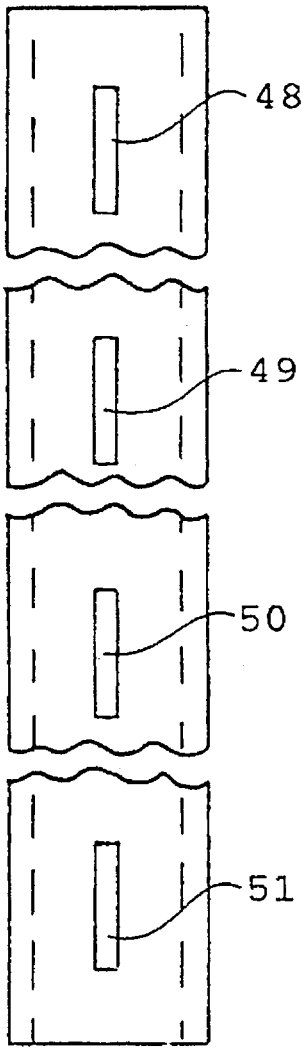
FIG. 23 is an elevational view of the right-hand vertical element of FIG. 21 showing the connection tabs.
Figure 24:
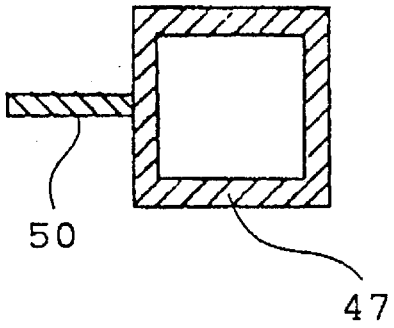
FIG. 24 is a cross-section plan view of the right-hand vertical element of FIG. 21 taken at line 24—24 of FIG. 21.

Interior wall sections are joined to each other and to exterior wall sections in the manner illustrated in FIGS. 19–24. FIG. 22 is an elevation of a vertical element 42 of an interior wall section. Uniform size openings 43, 44, 45 and 46 are provided in vertical element 42. FIG. 23 shows vertical element 47 of an interior wall section which is designed to be joined to vertical element 42. Tabs 48, 49, 50 and 51 extend from the surface of element 47, and each tab has a recess in its lowermost side adjoining vertical element 47. The horizontal edge of the recess of each tab is at the same height as the lower edge of each of the openings 43, 44, 45 and 46. FIG. 20 shows the vertical elements 42 and 47 partially assembled. FIG. 19 shows vertical elements 42 and 47 fully assembled. FIG. 24 is a cross-section showing that the tabs are perpendicular to the side of the vertical element to which they are attached.

Figure 27:
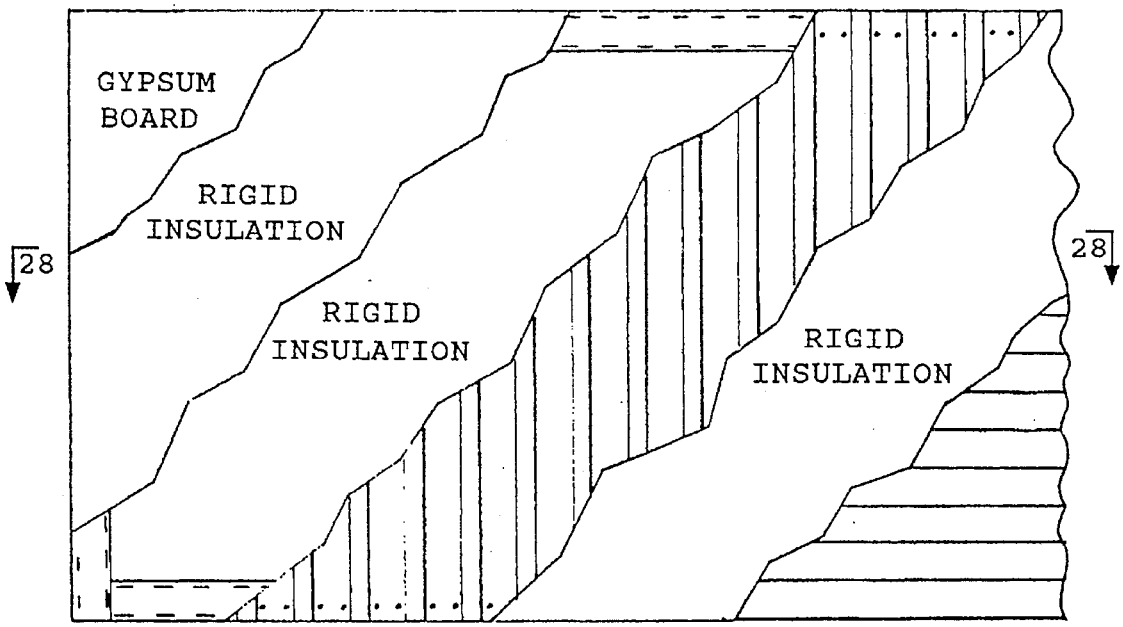
FIG. 27 is an elevational view of an exterior wall, showing in part the elements forming the wall.
Figure 28:
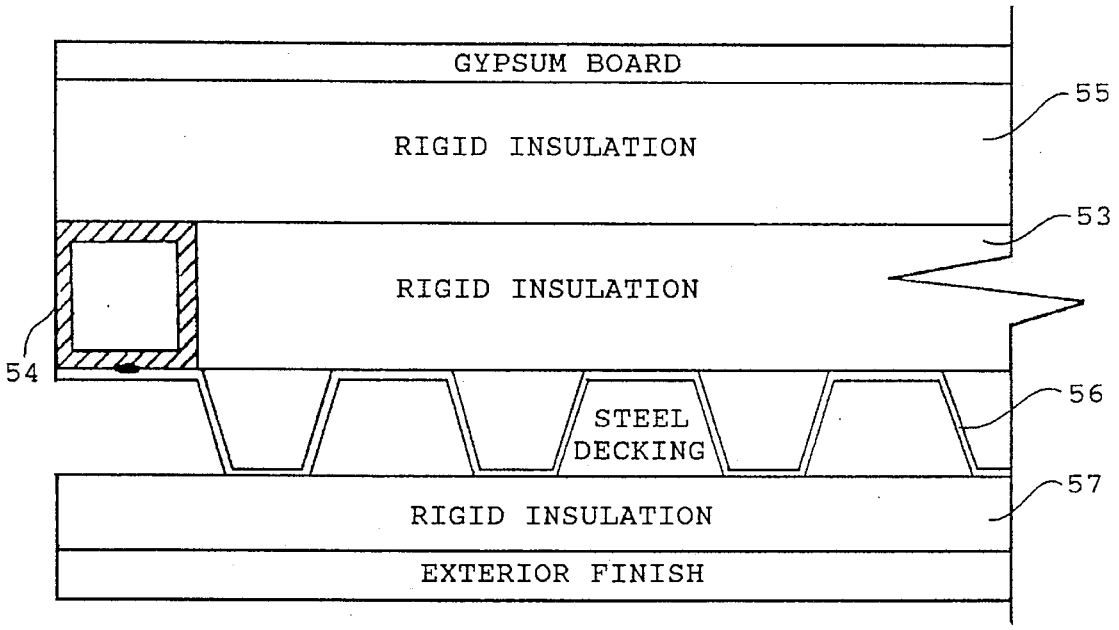
FIG. 28 is a sectional view of an exterior wall taken at line 28—28 of FIG. 27.

Construction of the exterior walls is illustrated in FIGS. 27 and 28. A panel 53 of rigid insulation is installed within tubular steel frame 54. An additional panel of rigid insulation 55 is attached to the inner side of panel 53 and steel frame 54. Conventional gypsum board is attached to the inner side of panel 55 by adhesive or screws or both. Steel decking 56 is welded to steel frame 54. An additional panel 57 of rigid insulation is attached to the outer side of steel decking 56. Exterior finish is then applied to the outer side of panel 57.

Figure 29:
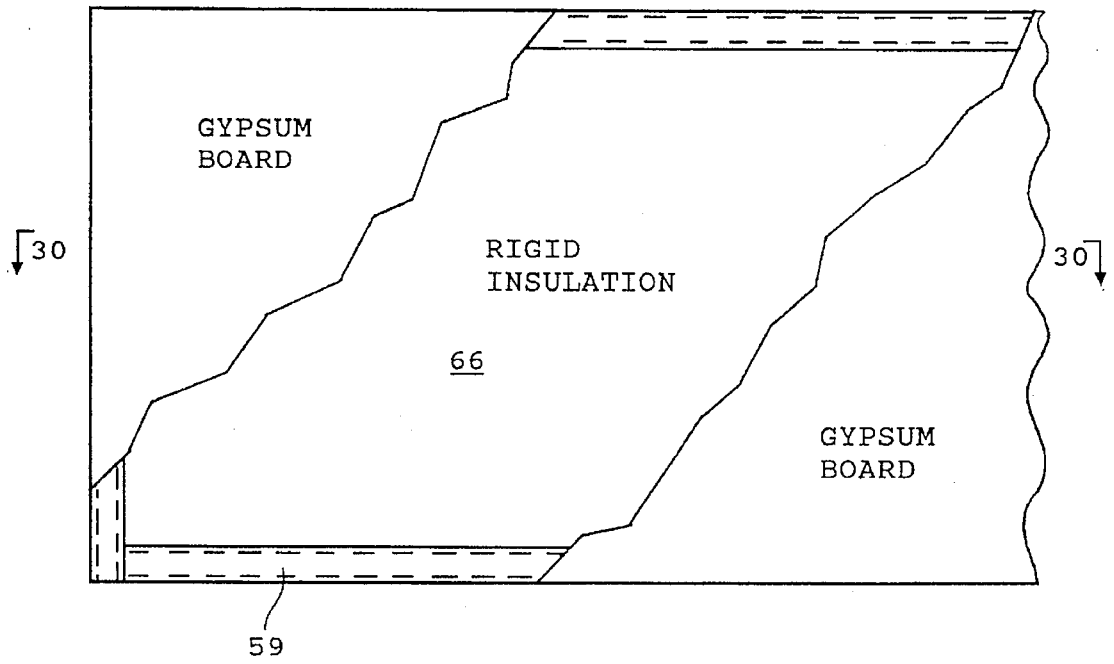
FIG. 29 is an elevational view of an interior wall showing in part the elements forming the interior wall.
Figure 30:
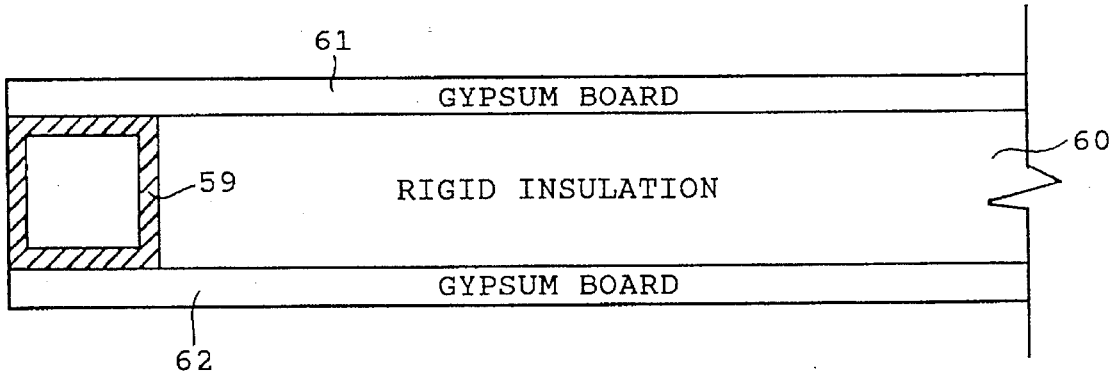
FIG. 30 is a sectional view of an interior wall taken at line 30—30 of FIG. 29.
Figure 31:
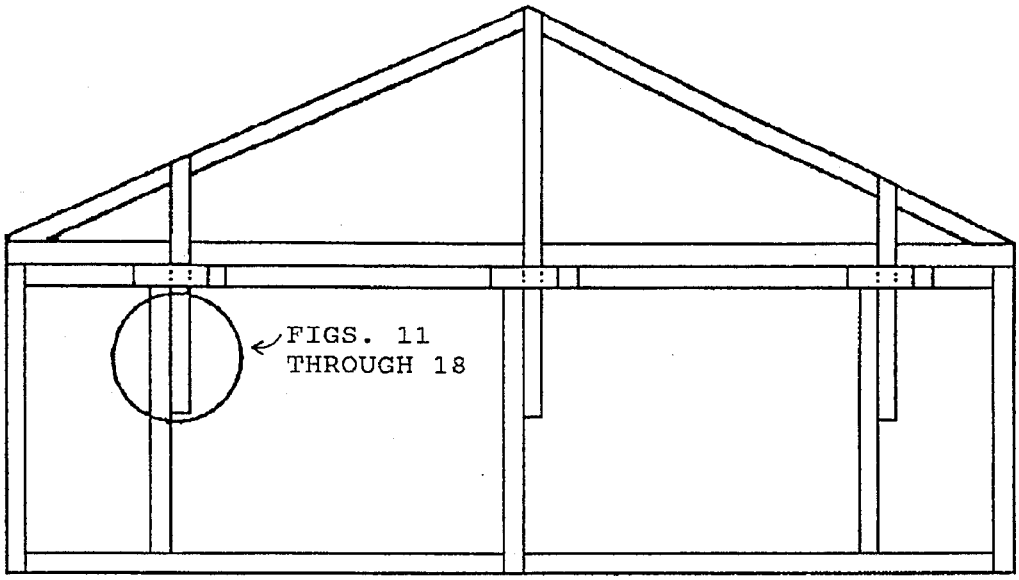
FIG. 31 is an elevational view of an end or intermediate support wall with a removable gable section.

Construction of interior wall panels is illustrated in FIGS. 29 and 30. Steel tubing framework 59 encloses a panel of rigid insulation 60. Gypsum board panels 61 and 62 are applied to framework 59 and insulation 60 by means of adhesive and screws.

Figure 25:
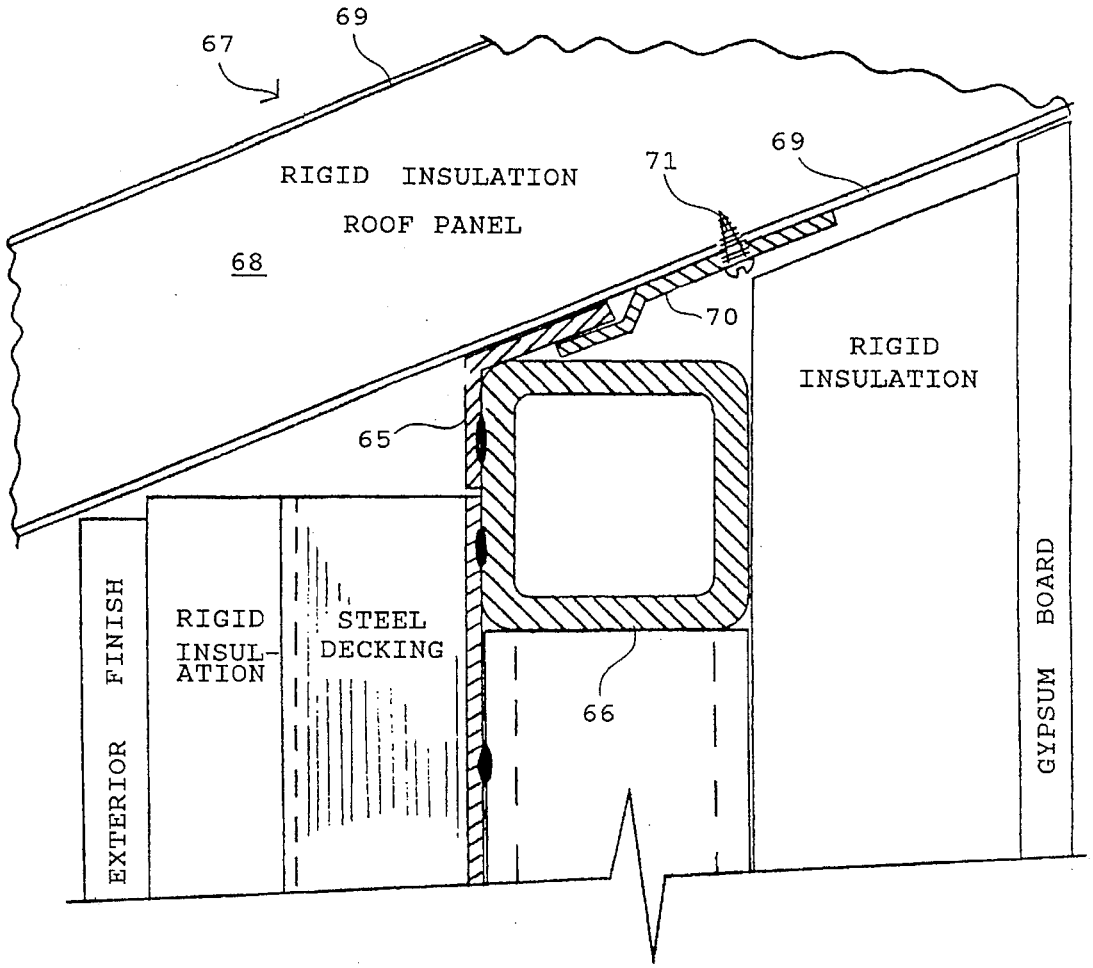
FIG. 25 is an elevational view of the attachment of a roof panel to an exterior side wall, taken at line 25—25 of FIG. 1-B.
Figure 26:
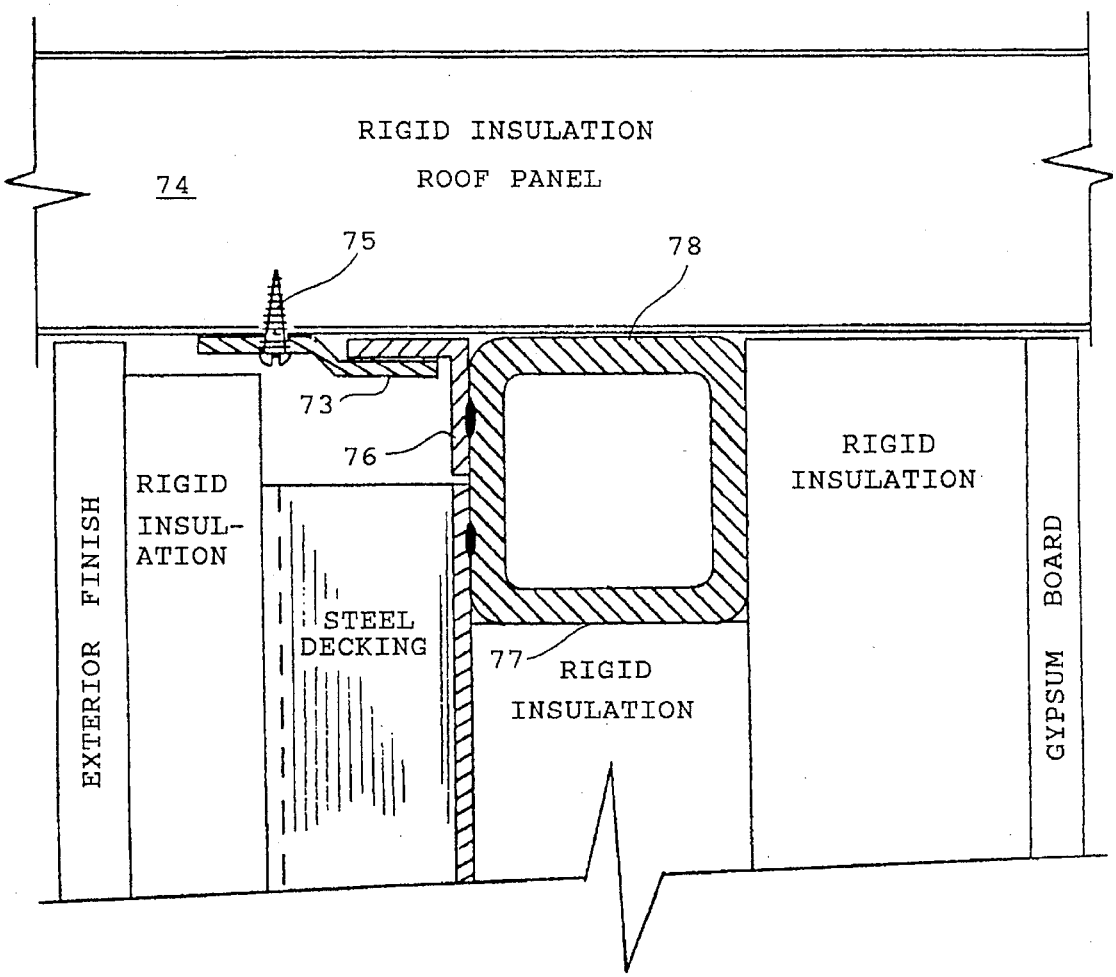
FIG. 26 is an elevational view of the attachment of a roof panel to an exterior end wall, taken at line 26—26 of FIG. 1-B.

Attachment of roof panels to the end walls and side walls is illustrated in FIGS. 25 and 26. Referring to FIG. 25, steel angle 65 is welded to the upper sloping member 66 of a side wall frame. Roof panel 67 is a block of rigid insulation 68 with sheet metal 69 adhesively attached to both sides of insulation 68. A strip of sheet metal 70 with a slight offset is attached to roof panel 67 with sheet metal screws 71. The offset of shet metal strip 70 slides into the recess formed between angle iron 65 and member 66.

Referring to FIG. 26, attachment of a roof panel to an end wall is illustrated. A strip of sheet metal 73 with a slight offset is attached to roof panel 74 with sheet metal screws 75. A right-angled sheet metal strip 76 is welded to upper member 77 of an end wall frame, with the projection of strip 76 at the same level as the uppermost side of end wall frame 78. The offset in strip 73 allows the insertion of angle strip 76 into the recess between strip 73 and roof panel 74, thus securing the roof panel to the exterior end walls. This slip type connection runs the full length of the exterior end walls.

Figure 32:
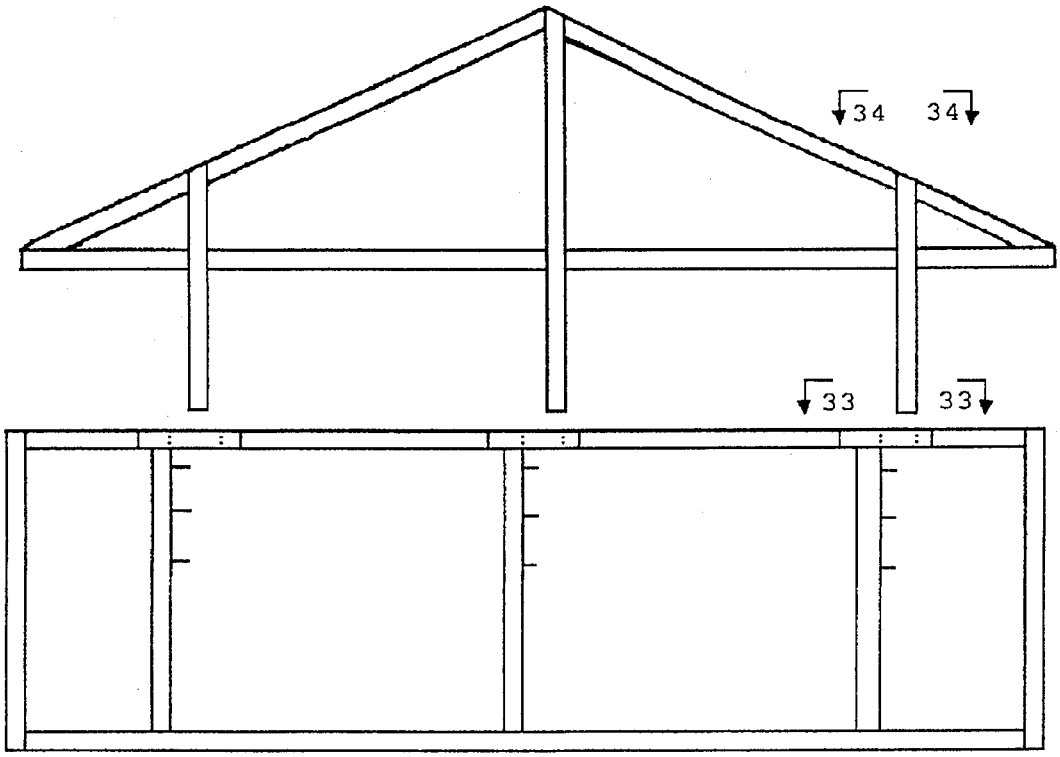
FIG. 32 is an elevational view of an end or intermediate support wall with a removable gable section, showing the gable section separated.
Figure 33:
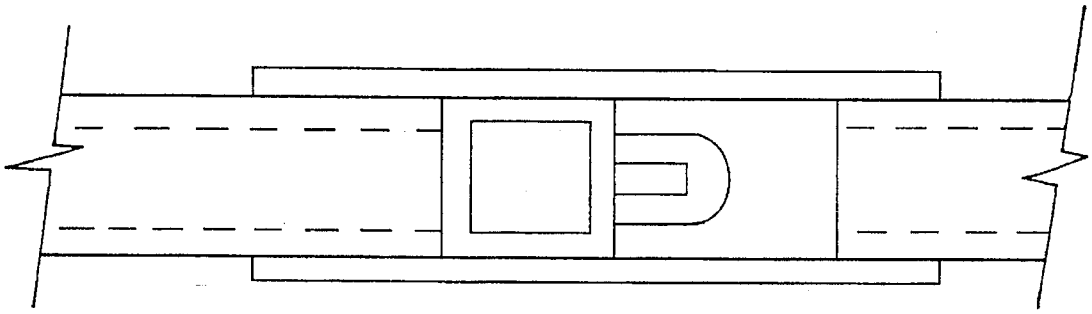
FIG. 33 is a plan view taken at line 33—33 of FIG. 32 showing the tab slots into which the vertical members of the gable are inserted.
Figure 34:
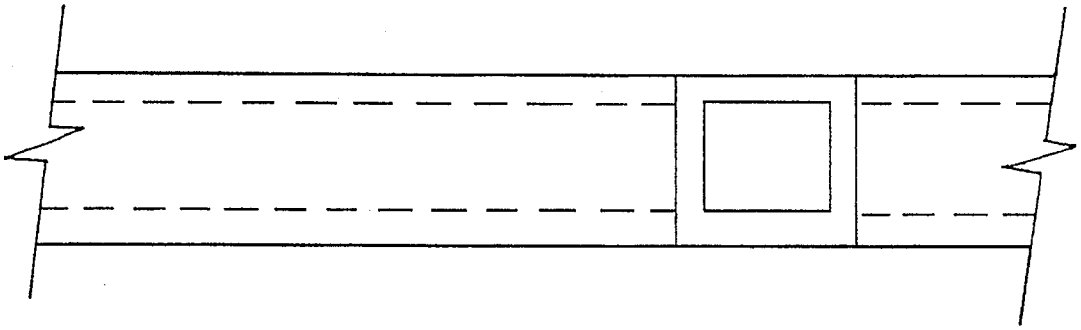
FIG. 34 is a plan view taken at line 34—34 of FIG. 32 showing the opening of the vertical member in the top of the gable.

The gable section of the end walls or intermediate support walls may at times be too tall for conventional shipping methods. A two piece wall design will overcome this potential problem. The wall is fabricated in two sections as illustrated in FIG. 32. The attachment method of the two sections is performed in the same manner as all other exterior wall connections as detailed in FIGS. 11–18. The number of connection points will vary with the building design. All other features of construction will remain as previously described. The lower section of the wall is erected and secured to the concrete slab. The upper gable section is then assembled to the lower section by inserting the protruding vertical members through the openings shown in FIG. 33. When the horizontal members are flush with each other, the gable section is then moved horizontally to allow insertion of the tabs into the openings provided in the vertical members of the upper wall section. The assembly is completed by insertion of the connection pins into the graduated slots in the tabs, which are now inside the vertical members of the upper wall section.

The roof system comprises rigid insulation panels covered on both sides with sheet metal. These panels are attached to the exterior walls as previously described, and are attached to the ridge and midpoint purlins with sheet metal screws. The roof panels, where required by code, will have gypsum board attached to the interior face by the use of adhesive and drywall screws. The exterior face of the roof panels will be covered by any one of many available roofing products.

The electrical system comprises wire harnesses which are prefabricated, and which will connect, with UL-approved connectors, to the pre-wired wall panels and the breaker panel box. The wall panels will have the wiring system installed at the fabrication shop.

All plumbing is assembled in the conventional manner.

The balance of the interior accompaniments (floor covering, cabinets, etc.) will be installed in the conventional manner.

The erection sequence would be:

a) Secure side wall panels 3 and 4 to the slab with anchor bolts and temporarily hold in a vertical position with bracing;

b) Erect either end wall 1 or 2 and mate up the exterior wall connections at both corners and secure with connection pins;

c) Erect the other end wall and mate up the exterior wall connections at both corners and secure with connection pins;

d) Erect and assemble all interior walls and, when squared, anchor to the slab;

e) Install the dropped ceiling where required;

f) Install the heating, ventilating and air conditioning ducts and equipment;

g) Secure the ridge and midpoint purlins to the end walls with bolts;

h) Install the roof panels, interlocking to the walls and each other. Secure the roof panels to the ridge and midpoint purlins with sheet metal screws;

i) Install the roofing system on the roof panels.

j) Connect the wiring harnesses to the wall panels and to the breaker box.

k) Install the cabinets and plumbing fixtures and connect the plumbing;

l) Apply finish to the exterior wall connection joints, and paint the interior;

m) Install the floor covering;

n) Install garage doors if required; and o) Start up the HVAC system.

There has been described above a structure for assembly on a concrete pad or foundation, said structure being capable of assembly or disassembly using only hand tools. Each component is completely shop fabricated or procured as a component.

While this invention is susceptible of embodiment in different forms, the drawings and the specification illustrate a preferred embodiment of the invention, with the understanding that the present disclosure is to be considered an exemplification of the principles of the invention, and the disclosure is not intended to limit the invention to the particular embodiment described.

I claim:

1. A building structure comprising:

a first exterior wall panel, the first exterior wall panel having a first vertical member and a plurality of tabs extending from the first vertical member, each of the tabs defining a connecting pin opening therein, the connecting pin openings being progressively smaller from a first end of the vertical member to a second end thereof;

a second exterior wall panel, the second exterior wall panel having a second vertical member, the second vertical member defining a plurality of tab receiving openings therein along a side of the second vertical member; and a connecting pin, the connecting pin having a graduated width from a first end thereof to a second end thereof such that the connecting pin is securingly receivable in each of the plurality of connecting pin openings when each of the tabs is received in each of the respective tab receiving openings of the second vertical member.

* * * * *